US005533931A

United States Patent [19]

Imai et al.

[11] Patent Number: 5,533,931

[45] Date of Patent: Jul. 9, 1996

[54] METHOD AND MACHINE FOR GRINDING A WORKPIECE

[75] Inventors: Tomoyasu Imai, Kariya; Ryohei Mukai, Nagoya, both of Japan

[73] Assignee: Toyoda Koki Kabushiki Kaisha, Kariya, Japan

[21] Appl. No.: 531,058

[22] Filed: Sep. 20, 1995

Related U.S. Application Data

[63] Continuation of Ser. No. 128,715, Sep. 30, 1993, abandoned.

[30] Foreign Application Priority Data

Sep. 30, 1992 [JP] Japan ..... 4-262140

[51] Int. Cl.[6] ..... B24B 49/00

[52] U.S. Cl. ..... 451/11; 451/49; 451/5; 451/21

[58] Field of Search ..... 451/1, 5, 21, 22, 451/49

[56] References Cited

U.S. PATENT DOCUMENTS

| | | | |
|---|---|---|---|
| 4,219,972 | 9/1980 | Ota et al. | 51/165.87 |
| 4,337,599 | 6/1982 | Koide et al. | 51/165.87 |
| 4,492,061 | 1/1985 | Smith | 51/165.87 |
| 4,502,125 | 2/1985 | Yoneda et al. | 51/165.87 |
| 4,571,891 | 2/1986 | Donner | 51/165.87 |
| 4,584,796 | 4/1986 | Yoneda | 51/165.87 |
| 5,048,235 | 9/1991 | Smith | 51/5 D |
| 5,183,026 | 2/1993 | Ohta et al. | 51/165.88 |
| 5,228,241 | 7/1993 | Ohta et al. | 51/165.71 |
| 5,271,187 | 12/1993 | Yoneda et al. | 51/165.87 |
| 5,272,843 | 12/1993 | Maruyama et al. | 51/165.87 |

FOREIGN PATENT DOCUMENTS

| | | |
|---|---|---|
| 0239161 | 9/1987 | European Pat. Off. . |
| 0312830 | 4/1989 | European Pat. Off. . |
| 0477732 | 4/1992 | European Pat. Off. . |
| 3817453 | 5/1988 | Germany . |
| 3136441 | 9/1989 | Germany . |

*Primary Examiner*—Bruce M. Kisliuk
*Assistant Examiner*—George Nguyen
*Attorney, Agent, or Firm*—Oblon, Spivak, McClelland, Maier & Neustadt

[57] ABSTRACT

A grinding wheel for grinding a workpiece has a first grinding surface and a second grinding surface successive thereto. The first and second grinding surfaces are parallel to and inclined with respect to the rotational axis of the workpiece, respectively. A diameter of the workpiece to be ground in a next grinding operation is measured in advance. An angle to be formed between the second grinding surface and the rotational axis of the workpiece is selected based upon the measured diameter of the workpiece. The selected angle is established between the second grinding surface and the rotational axis of the workpiece. The grinding wheel is moved relative to the workpiece in a direction of the rotational axis of the workpiece, whereby the cylindrical surface of the workpiece is firstly ground by the second grinding surface and subsequently ground by the first grinding surface of the grinding wheel.

12 Claims, 9 Drawing Sheets

| d | θ |
|---|---|
| 5 | 20 |
| ⋮ | ⋮ |
| 25 | 15 |
| ⋮ | ⋮ |
| 45 | 5 |
| ⋮ | ⋮ |
| 100 | 1 |

METHOD AND MACHINE FOR GRINDING A WORKPIECE

This application is a Continuation of application Ser. No. 08/128,715, filed on Sep. 30, 1993, now abandoned.

BACKGROUND OF THE INVENTION

1. Field of the Invention

The present invention relates to a method and a machine for grinding a cylindrical surface of a workpiece with a grinding wheel.

2. Discussion of the Prior Art

In a conventional grinding machine for traverse feed grinding, a grinding wheel has a straight grinding surface and a tapered grinding surface successive thereto. The straight grinding surface is parallel to the rotational axis of a workpiece to be ground, while the tapered grinding surface forms a predetermined angle with the rotational axis of the workpiece. When a cylindrical surface of the workpiece is ground with this grinding wheel, the grinding wheel is advanced at the position corresponding to one end of the workpiece so as to be fed into the workpiece. Then, the workpiece is traversed in a direction of its rotational axis. During this operation, the tapered grinding surface carries out rough grinding and subsequently, the straight grinding surface carries out fine grinding.

Since the grinding machine having such a grinding wheel can complete the grinding operation for the cylindrical surface of the workpiece through only one traverse feed, the time required for the grinding operation can be shortened. However, there are involved some problems regarding the above-mentioned grinding wheel.

In the case where the angle which the tapered grinding surface and the rotational axis of the workpiece W make is too large, the width A of the tapered grinding surface which acts on the workpiece W is narrow, as shown in FIG. 1(*a*). Under this condition, excessive loading acts on each grain of the tapered grinding surface, whereby abrasion of the grinding wheel G and grinding resistance become large. Conversely, in the case where the angle is too small, the width A is wide, as illustrated in FIG. 1(*b*). Each grain on the tapered grinding surface is subjected to a slight load which causes the grinding wheel G to slide or slip on the cylindrical surface of the workpiece W. Since these phenomena influence roundness and straightness of the ground workpiece W, it is difficult to attain desired roundness and straightness.

Further, the straight grinding surface of the grinding wheel G works to smooth the cylindrical surface of the workpiece W. If the length of the straight grinding surface is too short, it is difficult to attain a desired surface roughness.

SUMMARY OF THE INVENTION

Accordingly, it is an object of the present invention to provide an improved method and machine which enable a workpiece a be ground with desired roundness and straightness even when the grinding operation for the cylindrical surface of the workpiece is completed by traversing a grinding wheel only once.

Another object of the present invention is to provide method and machine capable of improving the surface roughness of the workpiece.

A specific object of the present invention is to provide an improved method and machine capable of setting the angle which a tapered grinding surface of a grinding wheel makes with the rotational axis of a workpiece, to a desired one with adaptation to changes in diameter of workpieces to be ground.

Briefly, in accordance with the present invention, a grinding wheel for grinding a workpiece is used having a first grinding surface and a second grinding surface successive thereto. The first and second grinding surfaces are parallel to and inclined with respect to the rotational axis of the workpiece, respectively. Based upon a diameter of the workpiece to be ground, an angle to be formed between the second grinding surface and the rotational axis of the workpiece is determined. The determined angle is then formed between the second grinding surface and the rotational axis of the workpiece, while maintaining said first grinding surface parallel with the rotational axis of said workpiece. Thereafter, the grinding wheel is moved relative to the workpiece in a direction parallel to the rotational axis of the workpiece so that the cylindrical surface of the workpiece is firstly ground by the second grinding surface and subsequently ground by the first grinding surface.

With this configuration, the most suitable angle between the second grinding surface and the rotational axis of the workpiece is selected depending upon the diameter of the workpiece to be ground. As a result, the grinding resistance can be decreased and the roundness of the workpiece can be improved.

Preferably, the length of the first grinding surface in the direction of the rotational axis of the workpiece is set to be at least 5 millimeters. Since the length of the first grinding surface in the direction of the rotational axis of the workpiece is set to the most suitable value regardless of the diameter of the workpiece, the surface roughness of the workpiece can be improved.

BRIEF DESCRIPTION OF THE ACCOMPANYING DRAWINGS

Various other objects, features and many of the attendant advantages of the present invention will be readily appreciated as the same becomes better understood by reference to the following detailed description of the preferred embodiment when considered in connection with the accompanying drawings, in which:

FIGS. 1(*a*) and (*b*) are explanatory views showing situations wherein a grinding wheel is grinding a workpiece in the prior art;

Figure 1A:
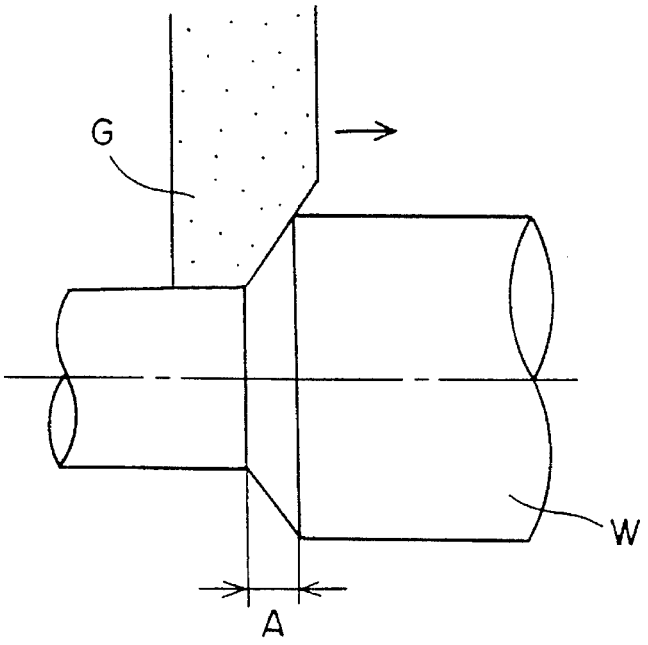
FIG. 1(a) (PRIOR ART)
Figure 1B:
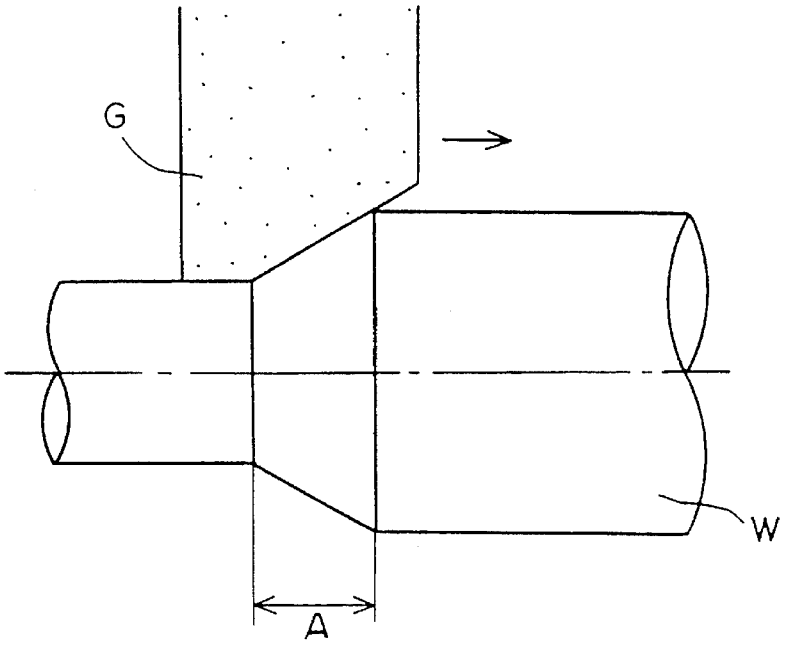
FIG. 1(b) (PRIOR ART)
Figure 2:
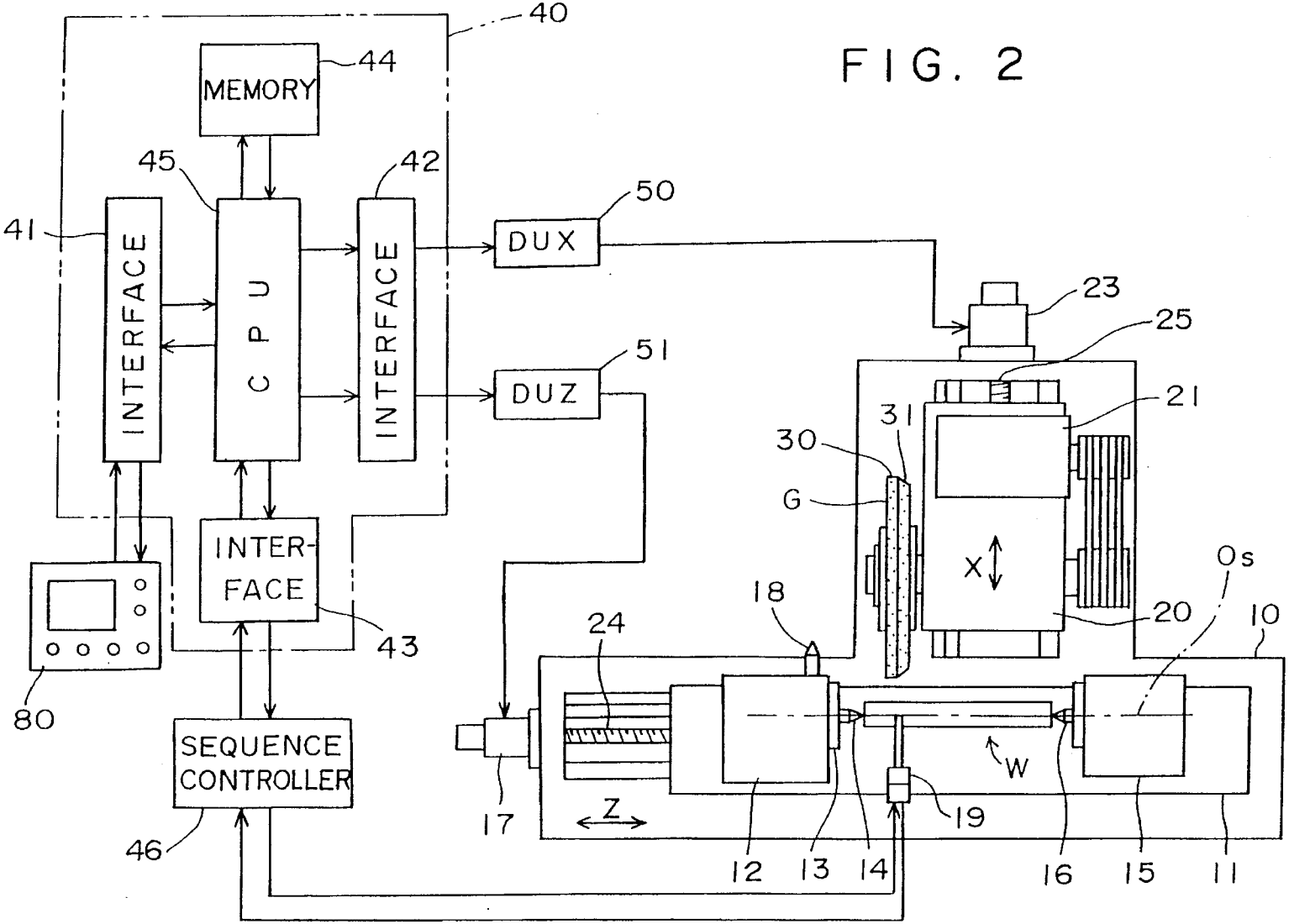
FIG. 2 is a plan view of a grinding machine according to the present invention, also illustrating a block diagram of an electric control system therefor.
Figure 4:
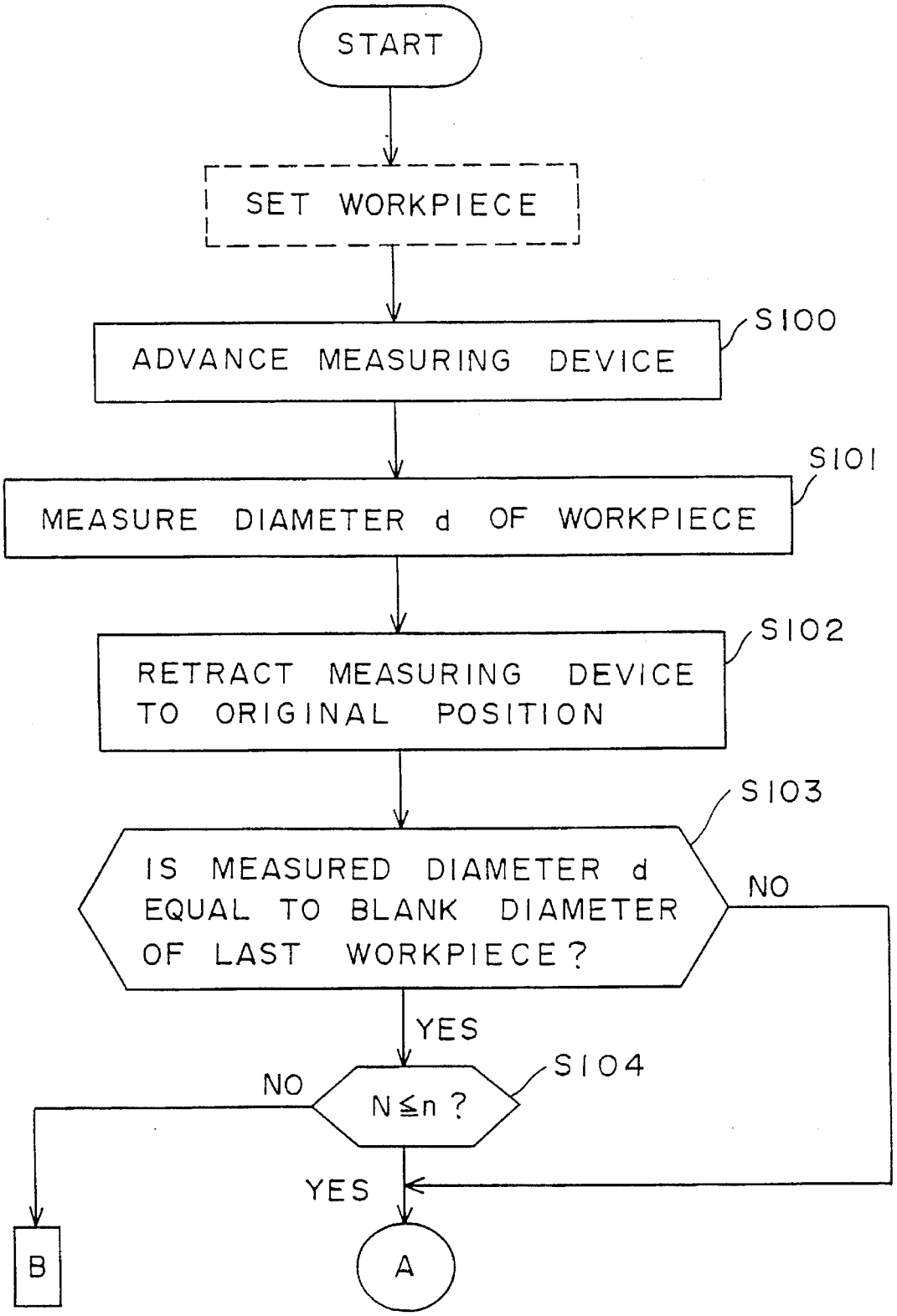
Figure 4:
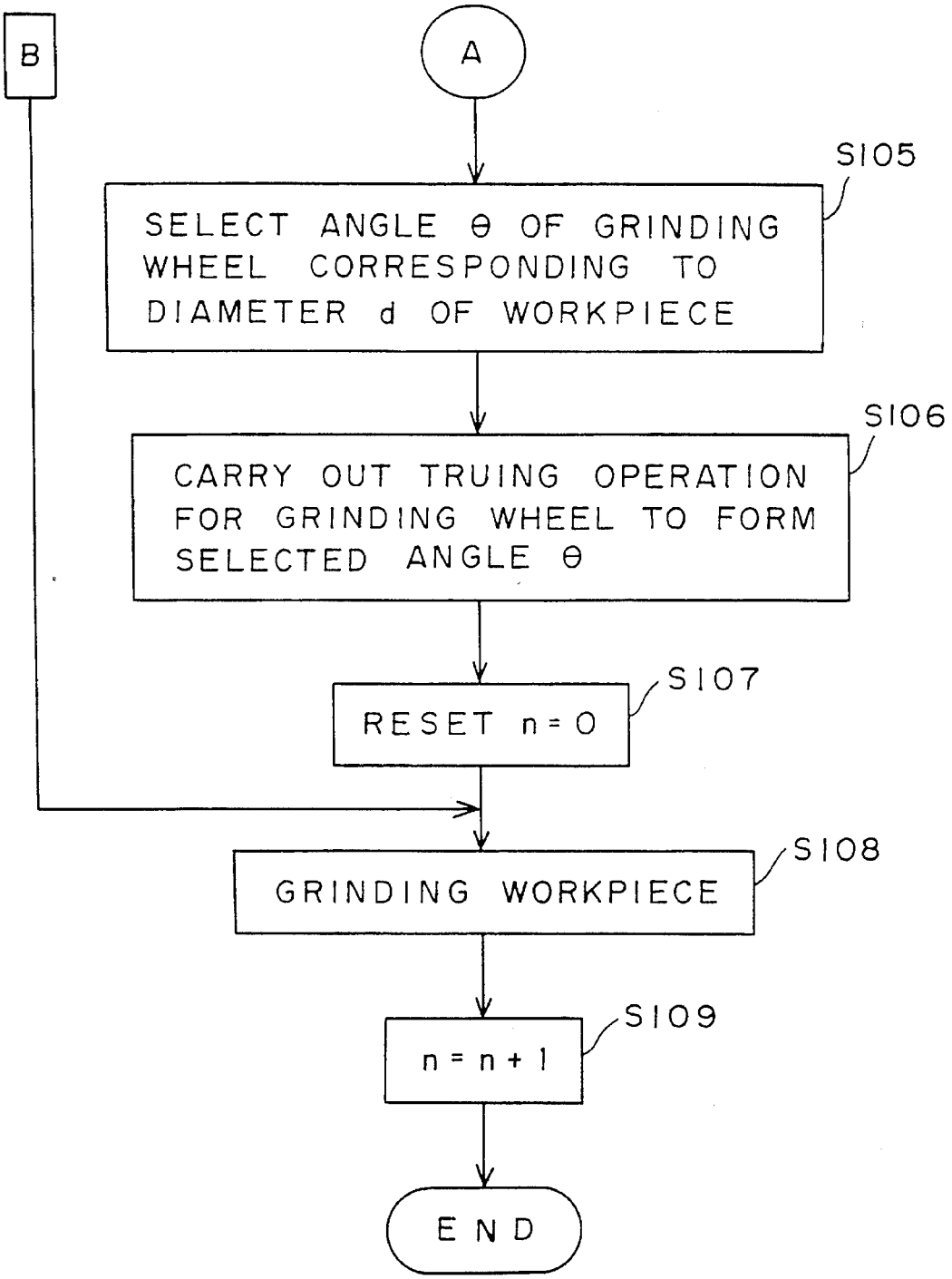
Figure 5:
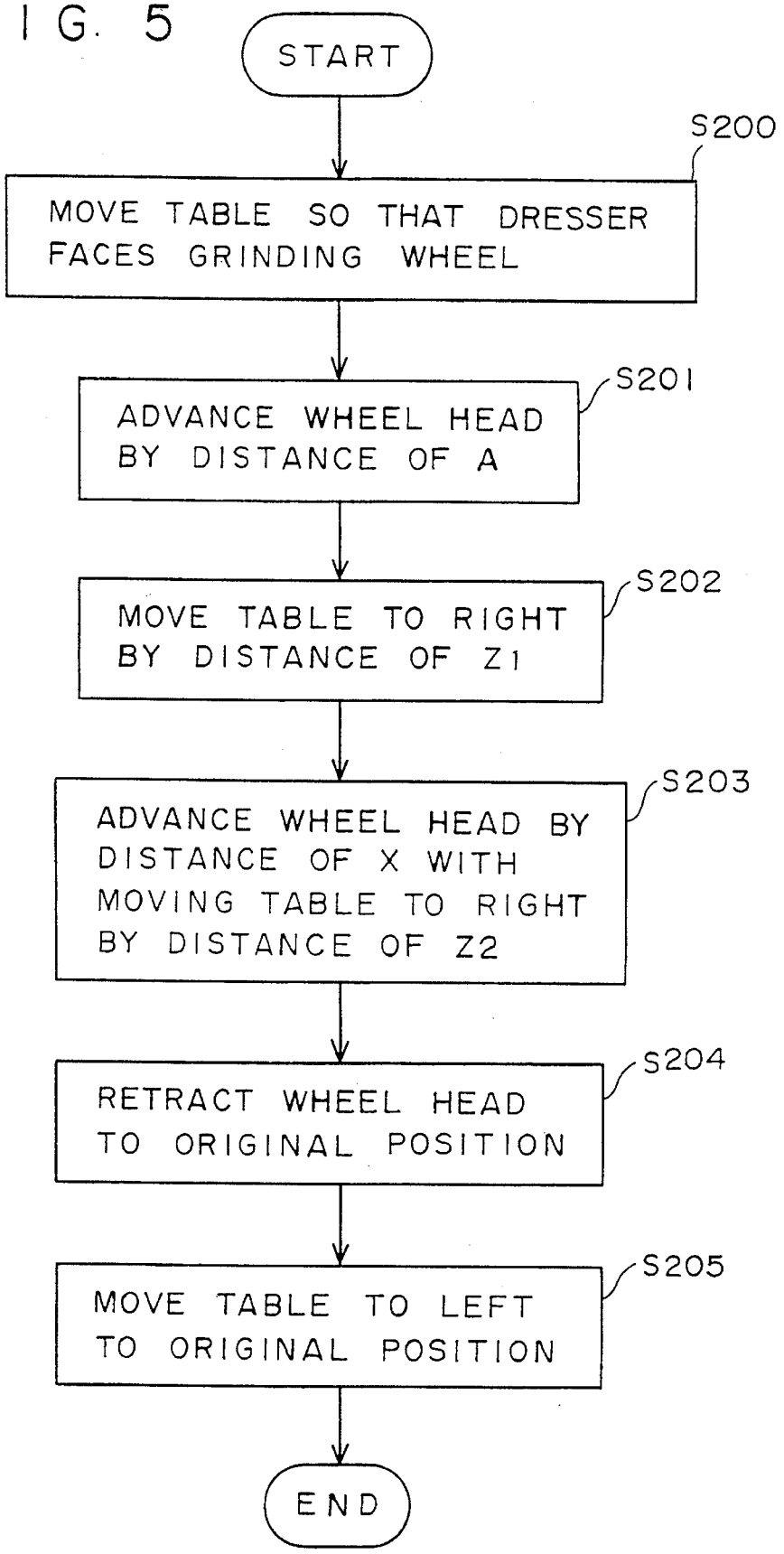
Figures 6, 7:
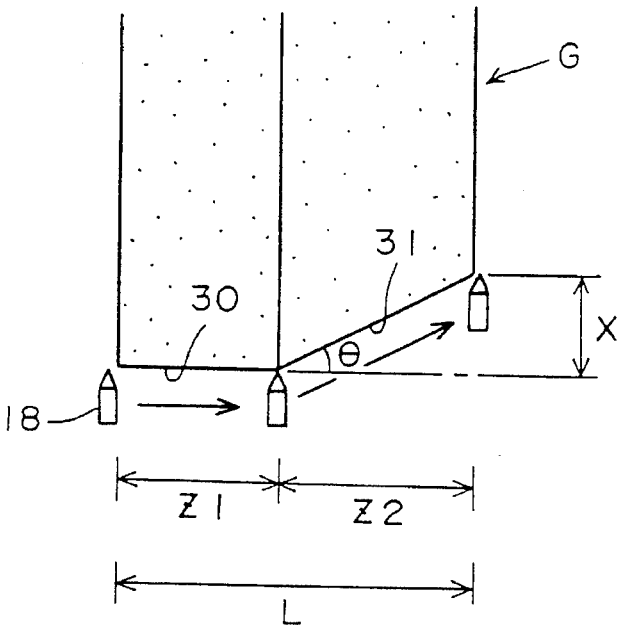
Figure 8A:
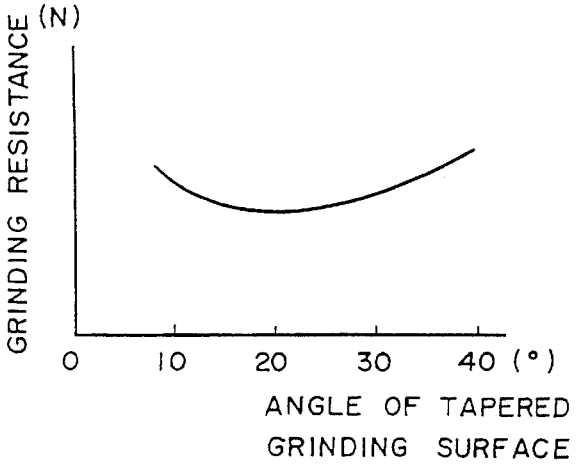
Figure 8B:
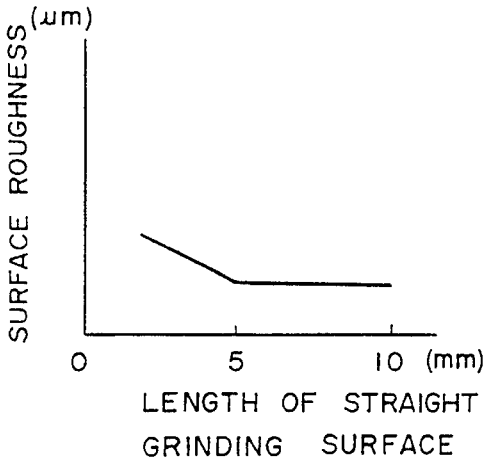

FIGS. 4(*a*) and (*b*) are flowcharts illustrating a grinding program executed by a CPU shown in FIG. 2;

FIG. 5 is a flowchart illustrating in detail a truing step shown in FIG. 4(*b*);

FIG. 6 is a data table indicating the angles of a tapered grinding surface which are to be selected depending upon changes in diameter of the workpiece;

FIG. 7 is an explanatory view showing the movement of the truing tool relative to the grinding wheel in a truing operation;

FIGS. 8(*a*), 9(*a*), 10(*a*) and 11(*a*) are graphs showing the relationship between the angles of the tapered grinding surface formed with the rotational axis of the workpiece and grinding resistances;

FIGS. 8(*b*), 9(*b*), 10(*b*) and 11(*b*) are graphs showing the relationship between the lengths of a straight grinding surface and the surface roughness of the ground workpiece.

DESCRIPTION OF THE PREFERRED EMBODIMENT

Referring now to the drawings and particularly to FIG. 2 thereof, there is shown a numerically controlled grinding machine embodying the concept of the present invention. This machine has a bed 10 on which a table 11 is placed. A headstock 12 supporting a spindle 13 and a tailstock 15 are mounted on the table 11. The table 11 is connected to a servomotor 17 via a feed screw mechanism 24 so as to be moved in a Z-axis direction that is parallel to the rotational axis Os of the spindle 13. A workpiece W is rotational held between a center 14 of the spindle 13 and a center 16 of the tailstock 15. Disposed on the bed 10 is a measuring device 19 for measuring the diameter of the workpiece W.

A grinding wheel head 20 is mounted at the top rear of the bed 10 in such a way that the wheel head 17 is movable in an X-axis direction that is perpendicular to the Z-axis direction. The wheel head 20 is connected to a servomotor 23 via a feed screw mechanism 25 so as to be moved by the servomotor 23. A grinding wheel G is supported on the wheel head 20 and is driven by a motor 21. The table 21 is further provided with a truing tool or truer 18 for truing a grinding surface of the grinding wheel G.

Figure 3:
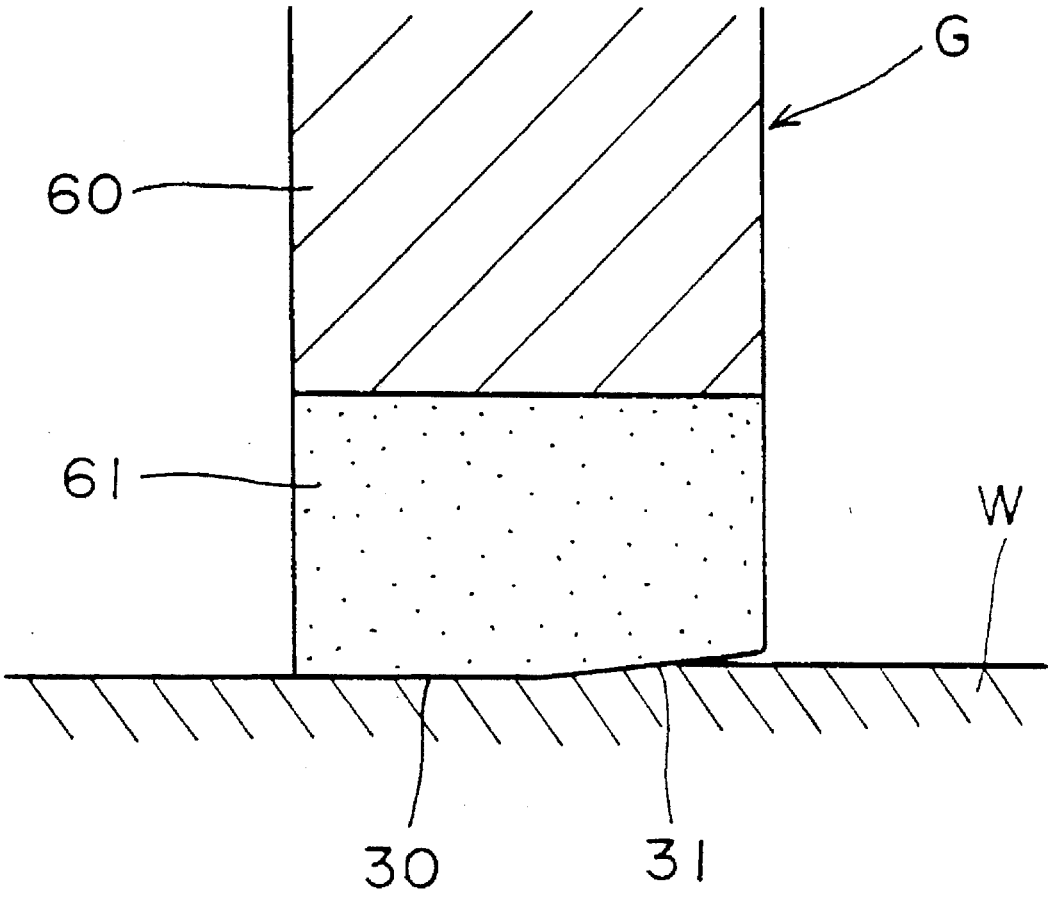
FIG. 3 is an enlarged fragmentary sectional view of a grinding wheel used in the present invention.

The grinding wheel G is composed of a circular wheel core 60 and a grinding layer 61 bonded on the circumference of the wheel core 60, as viewed in FIG. 3. In the grinding layer 61, numerous CBN grains are bonded to one another using vitrified bond. The grinding wheel G has a straight grinding surface 30 and a tapered grinding surface 31 successive thereto. The straight grinding surface 30 extends parallel to the rotational axis of the workpiece W, while the tapered grinding surface 31 extends inclined with respect to the rotational axis of the workpiece W, at an acute angle.

Turning back to FIG. 2, the numeral 40 denotes a numerical controller which is composed of a central processing unit 45 (referred to as "CPU" hereinafter), a memory 44 and interfaces 41, 42, 43. An operator's panel 80 is connected to the CPU 45 through the interface 41 to input machining program data, machining condition data and so on. Drive circuits 50 and 51 are also connected to the CPU through the interface 42 to drive the servomotors 23 and 17, respectively. The measuring device 19 is connected to the CPU 45 through the interface 43 and a sequence controller 46.

In the memory 44, there are formed plural data memory areas such as a machining program memory area and a machining condition data memory area.

Operation of the grinding machine in grinding the workpiece according to the present invention will now be described with reference to to the flowcharts shown in FIGS. 4(*a*), (*b*) and 5.

FIGS. 4(*a*) and (*b*) are the routine of a grinding program for controlling a grinding operation. When a workpiece W is set between the headstock 12 and the tailstock 15, and when the operator pushes one of buttons (a grinding start button) on the operator's panel 80, the measuring device 19 is advanced toward the workpiece W, at step S100. Next step S101 follows to measure the diameter d of the workpiece W by the measuring device 19. Step S102 is then executed wherein the measuring device 19 is retracted to the original position. It is judged at next step S103 whether or not the measured diameter d is equal to the blank diameter of the workpiece ground in the last grinding operation. If the judgement is "YES", the process proceeds to step S104. If the judgement is "NO", the process proceeds to step S105 described later.

Subsequently, it is judged at step S104 whether or not the parameter n representing the number of the workpieces which have been ground after the last truing operation is equal to or larger than value N. This value N indicates the number of the ground workpieces which would be reached when the length of the straight grinding surface 30 in the direction of the rotational axis Os of the workpiece W becomes shorter than 2 millimeters. The value N may be determined empirically or experimentally. If the parameter n indicates equal to or larger than the value N, the process proceeds to step S104. If the parameter n is smaller than the value N, the process proceeds to step S108 described later.

At step S105, the angle θ to be formed between the rotational axis Os of the workpiece W and the tapered grinding surface 31 is selected by reference to the diameter d of the workpiece W measured at step S101. The angles θ of the tapered grinding surface 31 corresponding to the diameters d of the workpiece W are stored in a data table of the memory 44, as shown in FIG. 6. It is noted that the angle θ is decreased with increase of the diameter d. At next step S106, the grinding wheel G is trued by the truer 18 so that the straight grinding surface 30 have a length equal to or larger than 5 millimeters in the direction of the rotational axis of the workpiece W and that tapered grinding surface 31 forms the selected angle θ with the rotational axis Os of the workpiece W. Then, the parameter n is reset to zero at step S107.

At next step S108, the workpiece W is ground by the grinding wheel G. At first, the table 11 is moved to that position where the left end of the workpiece W faces the grinding wheel G. The grinding wheel G and the workpiece W are rotated and the wheel head 20 is advanced toward the workpiece W by a predetermined amount. After that, the table 11 is traversed toward the left as viewed in FIG. 2 in a direction of the rotational axis of the workpiece W. During this operation, the tapered grinding surface 31 carries out a rough grinding on the outer surface of the workpiece W, at the same time of which the straight grinding surface 30 following the tapered one 31 carries out a fine grinding on the roughly ground outer surface. The table 11 is stopped when the grinding wheel G has passed the right end of the workpiece W. The wheel head 20 is then retracted to its original position. The grinding operation for the cylindrical surface of the workpiece W is thus completed. Thereafter, at step S109, the parameter n is increased by one.

The truing operation at step S106 is executed in accordance with those steps illustrated in detail in FIG. 5. Firstly, at step S200, the table 11 is moved in Z-axis direction until the truer 18 is positioned at the left of the left end of the grinding wheel G, as shown in FIG. 7. At step S201, the feed amount A of the wheel head 20 is calculated and the wheel head 20 is advanced toward the workpiece W by the calculated amount of A.

Next, at step S202, the table 11 is moved to right by a distance Z1 which is equal to or longer than 5 millimeters. At next step S203, the servomotors 23 and 17 are simultaneously controlled, whereby the wheel head 20 is advanced by distance of X as the table 11 is moved to right by distance of Z2. Here, the distances Z2 and X are calculated by the following equations:

$$Z2=-Z1$$

$$X=\tan\theta\cdot Z2$$

Where the known value L is the width of the grinding wheel G.

During this operation, the grinding wheel G is trued to a desired shape, wherein the straight grinding surface 30 have length equal to or larger than 5 millimeters in the direction of rotational axis of the workpiece W while the tapered grinding surface 31 forms the selected angle θ with the rotational axis of the workpiece W. Step S204 is next reached to move back the wheel head 20 by the distance of (A+X) to return the same its original position. Thereafter, at step S205, the table 11 is moved to the left by the distance of (Z1+Z2) to be returned its original position.

Figure 9A:
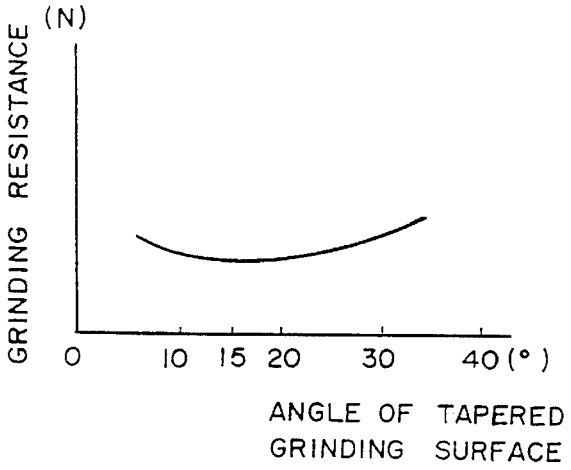
Figure 9B:
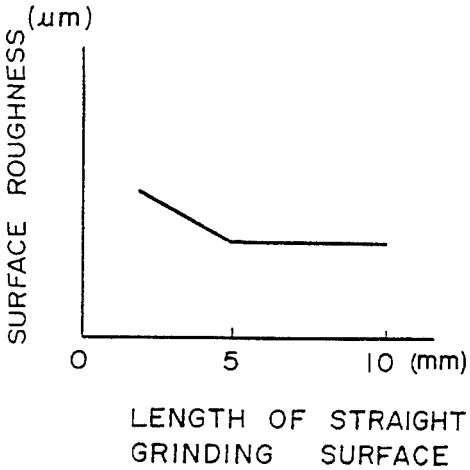
Figure 10A:
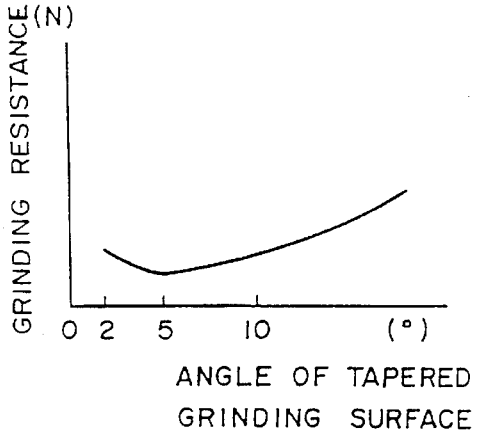
Figure 10B:
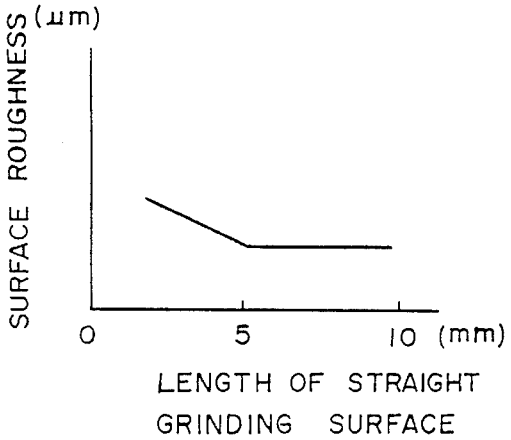
Figure 11A:
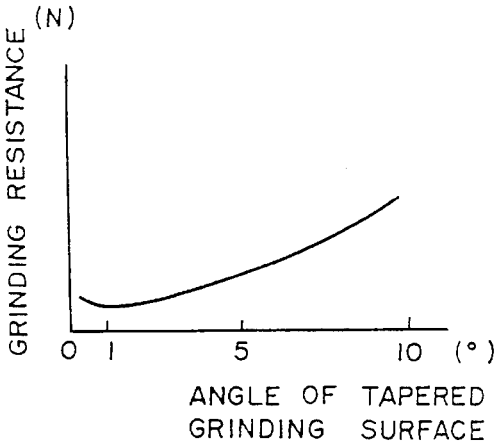
Figure 11B:
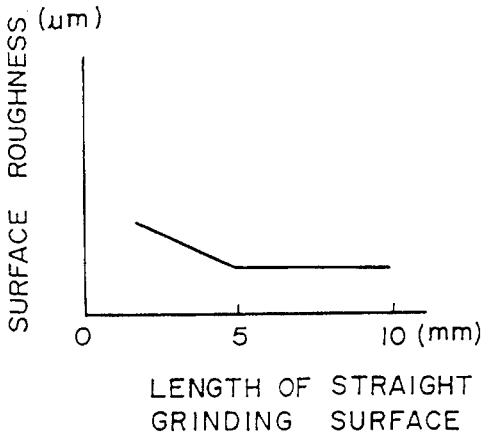

In FIGS. 8(*a*), 9(*a*), 10(*a*) and 11(*a*), there are shown the relationship between inclined angles θ of the tapered grinding surfaces 31 and the grinding resistance. In any case, the diameter and width of the grinding wheel G are 400 millimeters and 10 millimeters, respectively, the length of the straight grinding surface 30 in the direction of the rotational axis of the workpiece W is 5 millimeters, and the peripheral speed of the grinding wheel G is 160 m/s. In the case where the diameter of the workpiece W is 5 millimeters, the grinding resistance is minimized at the angle of 20°, as illustrated in FIG. 8(*a*). Namely, since the difference of the amount by which the workpiece W runs off from the grinding wheel G becomes small between the both ends and the middle portion of the workpiece W, the roundness of the workpiece W can be improved when the angle θ between the tapered grinding surface 31 and the rotational axis of the workpiece W is chosen to be 20°. In the case where the diameter of the workpiece W is 25 millimeters, the grinding resistance is minimized at the angle of 15°, as illustrated in FIG. 9(*a*). In the case where the diameter of the workpiece W is 45 millimeters, the grinding resistance is minimized at the angle of 5°, as illustrated in FIG. 10(*a*). Further in the case where the diameter of the workpiece W is 100 millimeters, the grinding resistance is minimized at the angle of 1°, as illustrated in FIG. 11(*a*). Therefore, if the diameter of the workpiece exists in the range between 5 millimeters and 100 millimeters, the inclined angle of the tapered grinding surface 31 is selected to be decreased with the increases of the diameter of the workpiece between 1° and 20°.

FIGS. 8(*b*), 9(*b*), 10(*b*) and 11(*b*) show the relationship between the lengths of the straight grinding surfaces 30 in the direction of the rotational axis of the workpiece W and the surface roughness of the ground workpiece W. In any case, the diameter and width of the grinding wheel G are 400 millimeters and 10 millimeters, respectively, and the peripheral speed of the grinding wheel G is 160 m/s. The diameters of the workpieces W used in cases shown in FIGS. 8(*b*), 9(*b*), 10(*b*) and 11(*b*) correspond to those used in cases shown in FIGS. 8(*a*), 9(*a*), 10(*a*) and 11(*a*). In any case, the surface roughness of the workpiece W can be improved when the length of the straight grinding surface 30 is equal to or longer than 5 millimeters.

Although the angle θ varied depending on the diameter of the workpiece is formed by truing the grinding wheel in the present embodiment, the operator may change the grinding wheel to another one in which the tapered grinding surface has such a selected angle.

As described above, in the present invention, the desired angle θ of the tapered grinding surface 31 is selected based upon the diameter of the workpiece. As a result, the grinding resistance can be decreased and the roundness of the workpiece can be improved. Further, the surface roughness of the workpiece can be improved by setting the length of the straight grinding surface 30 in the direction of the rotational axis of the workpiece to a suitable value, regardless of the diameter of the workpiece.

In the traverse grinding operation, the traverse feed of the workpiece relative to the grinding wheel may be repeated several times if the grinding allowance of a workpiece is considerably large. Further, subsequently to the first or final traverse feed with a grinding infeed depth, one additional traverse feed may be carried out with the grinding infeed depth being not given, for improvement in the surface roughness.

Although in the embodiment, a measuring device is used to measure the diameter of a workpiece prior to the actual grinding thereof, the present invention is not limited to using such measuring device. The diameter of a workpiece to be machined may otherwise be obtained from a numerical control data being stored in the numerical controller, so that the angle to be formed between the tapered grinding surface and the rotational axis of the workpiece can be selected by reference to the stored diameter of the workpiece.

In this modified case, steps S100–S102 may be replaced by one or more steps of retrieving the diameter of a workpiece to be ground next, from the memory 44 which has stored numerical control data for the workpiece, and the workpiece diameter used at step S103 may be that retrieved at such single or more steps. Further, the retrieved diameter may be the blank diameter or a target or finished diameter of the workpiece.

Obviously, numerous modifications and variations of the present invention are possible in light of the above teachings. It is therefore to be understood that within the scope of the appended claims, the present invention may be practiced otherwise than as specially described herein.

What is claimed is:

1. A method of grinding a cylindrical surface of a workpiece with a grinding wheel having a first grinding surface parallel to the rotational axis of the workpiece and a second grinding surface successive to the first grinding surface and inclined with respect to the rotational axis of the workpiece, by effecting relative movement between said workpiece and said grinding wheel in the axial direction of said workpiece so that the cylindrical surface is roughly ground with the second grinding surface and at the same time, the portion of said cylindrical surface having been ground with the second grinding surface is finely ground with the first grinding surface, said method comprising the steps of:

selecting an angle to be formed between said second grinding surface and the rotational axis of said workpiece depending upon the diameter of the cylindrical surface of said workpiece to be ground;

forming the selected angle between said second grinding surface and the rotational axis of said workpiece while maintaining said first grinding surface parallel with the rotational axis of said workpiece; and moving said grinding wheel relative to said workpiece in the axial direction of said workpiece to roughly grind the cylindrical surface of said workpiece with the second grinding surface and at the same time, finely grinding the roughly ground portion of said cylindrical surface with the first grinding surface, wherein said selected angle formed between said second grinding surface and the rotational axis of said workpiece is made smaller with an increase in the diameter of said workpiece and said angle being such that the grinding resistance is minimized.

2. A method of grinding a cylindrical surface of a workpiece with a grinding wheel as set forth in claim 1, wherein said selected angle is in a range between 1° and 20° when the diameter of the workpiece ranges between 5 millimeters and 100 millimeters.

3. A method of grinding a cylindrical surface of a workpiece with a grinding wheel as set forth in claim 1, wherein the length of said first grinding surface in the direction of the rotational axis of said workpiece is at least 5 millimeters.

4. A method of grinding a cylindrical surface of a workpiece with a grinding wheel as set forth in claim 1, wherein said method further comprises the step of measuring a diameter of the workpiece and wherein said step of selecting an angle is performed based upon the diameter of said workpiece measured at the measuring step.

5. A machine for grinding a cylindrical surface of a workpiece with a grinding wheel having a first grinding surface parallel to the rotational axis of the workpiece and a second grinding surface successive to the first grinding surface and inclined with respect to the rotational axis of the workpiece, said machine including a workpiece support table for rotatably carrying said workpiece, a wheel head rotatably carrying said grinding wheel, feed means connected to said table and said wheel head to effect relative movement between said table and said wheel head in radial and axial directions of the workpiece, and control means for controlling said feed means so that during relative movement between said table and said wheel head in the axial direction of said workpiece, the second grinding surface roughly grinds the cylindrical surface and at the same time, the first grinding surface finely grinds the roughly ground portion of the cylindrical surface, said machine further comprising:

means for selecting an angle to be formed between said second grinding surface and the rotational axis of said workpiece depending upon the diameter of the cylindrical surface of said workpiece to be ground; and means for forming the selected angle between said second grinding surface and the rotational axis of said workpiece while maintaining said first grinding surface parallel with the rotational axis of said workpiece; wherein said selecting means includes means for selecting the angle formed between said second grinding surface and the rotational axis of said workpiece so as to be made smaller with an increase in the diameter of said workpiece and said angle being such that the grinding resistance is minimized.

6. A machine for grinding a cylindrical surface of a workpiece with a grinding wheel as set forth in claim 5, wherein said selected angle is in a range between 1° and 20° when the diameter of the workpiece ranges between 5 millimeters and 100 millimeters.

7. A machine for grinding a cylindrical surface of a workpiece with a grinding wheel as set forth in claim 5, wherein the length of said first grinding surface in the direction of the rotational axis of said workpiece is at least 5 millimeters.

8. A machine for grinding a cylindrical surface of a workpiece with a grinding wheel as set forth in claim 5, wherein said machine further comprises measuring means for measuring a diameter of the workpiece, and wherein said selecting means selects the angle based upon a diameter measured by said measuring means.

9. A machine for grinding a cylindrical surface of a workpiece with a grinding wheel having a first grinding surface parallel to the rotational axis of the workpiece and a second grinding surface successive to the first grinding surface and inclined with respect to the rotational axis of the workpiece, said machine including a workpiece support table rotatably carrying said workpiece, a wheel head rotatably carrying said grinding wheel, a feed mechanism connected to said table and said wheel head to effect relative movement between said table and said wheel head in radial and axial directions of the workpiece, and a control mechanism controlling said feed mechanism so that during relative movement between said table and said wheel head in the axial direction of said workpiece, the second grinding surface roughly grinds the cylindrical surface and at the same time, the first grinding surface finely grinds the roughly ground portion of the cylindrical surface, said machine further comprising:

a mechanism selecting an angle to be formed between said second grinding surface and the rotational axis of said workpiece depending upon the diameter of the cylindrical surface of said workpiece to be ground; and a mechanism forming the selected angle between said second grinding surface and the rotational axis of said workpiece while maintaining said first grinding surface parallel with the rotational axis of said workpiece; wherein said selecting mechanism selects the angle formed between said second grinding surface and the rotational axis of said workpiece so as to be made smaller with an increase in the diameter of said workpiece and said angle being such that the grinding resistance is miminized.

10. A machine for grinding a cylindrical surface of a workpiece with a grinding wheel as set forth in claim 9, wherein said selected angle is in a range between 1° and 20° when the diameter of the workpiece ranges between 5 millimeters and 100 millimeters.

11. A machine for grinding a cylindrical surface of a workpiece with a grinding wheel as set forth in claim 9, wherein said machine further comprises a counting mechanism counting the number of ground workpieces, and a mechanism operating said forming mechanism when said counting mechanism indicates a predetermined value representing that the length of said first grinding surface becomes shorter to about 2 millimeters, so that said forming mechanism restores the length of said first grinding surface in the direction of the rotational axis of said workpiece to at least 5 millimeters.

12. A machine for grinding a cylindrical surface of a workpiece with a grinding wheel as set forth in claim 9, wherein said machine comprises a measuring mechanism measuring a diameter of the workpiece, and wherein said selecting mechanism selects the angle based upon a diameter measured by said measuring mechanism.

* * * * *